United States Patent [19]

Seidler

[11] 4,068,917

[45] Jan. 17, 1978

[54] ELECTRICAL CONTACT SOCKET

[75] Inventor: Jack Harold Seidler, Flushing, N.Y.

[73] Assignee: Akzona Incorporated, Asheville, N.C.

[21] Appl. No.: 734,569

[22] Filed: Oct. 21, 1976

[51] Int. Cl.[2] ..... H01R 13/12

[52] U.S. Cl. ..... 339/258 R

[58] Field of Search ..... 339/223, 258

[56] References Cited

U.S. PATENT DOCUMENTS

| | | | |
|---|---|---|---|
| 1,194,122 | 8/1916 | Ball | 339/258 R |
| 1,635,256 | 7/1927 | Carter | 339/258 C |
| 3,155,450 | 11/1964 | Filson | 339/258 R |
| 3,246,284 | 4/1966 | Farison | 339/258 C |
| 3,406,376 | 10/1968 | Varrin | 339/258 R |

*Primary Examiner*—Joseph H. McGlynn

*Attorney, Agent, or Firm*—David M. Carter; Francis W. Young

[57] ABSTRACT

There is provided a contact socket for use in an electrical connector. The socket is tubular in shape and includes an integral L-shaped spring member attached to a tubular member. The spring member is bent to the inside of the tubular member and may be curved to conform to the curvature of the tubular member. The spring member provides electrical and mechanical contact for an associated contact pin.

16 Claims, 5 Drawing Figures

ELECTRICAL CONTACT SOCKET

BACKGROUND OF THE INVENTION

This invention relates to an improved socket contact for use in electrical connectors. More particularly, it relates to a tubular electrical contact having a spring member integral therewith.

Electrical socket contacts, sometimes referred to as female contacts, are provided to receive a corresponding pin contacts, sometimes referred to as male contacts. If a socket contact is used without an associated spring member, quite often the socket contact will become loose after a frequent number of insertions and retractions of the pin contact. Various types of spring members have, therefore, been provided to alleviate some of the problems of bad mechanical and electrical connections due to the deformation of socket contacts.

Many of the prior art connectors utilize a separate, non-integral spring member which is secured inside the tubular portion of the contact. However, since the spring member is not integral with the cylindrical socket, it requires the manufacture of separate pieces and also requires an assembly procedure of combining the two.

Another type of prior art socket contact includes an integral spring member bent from the front part of the tubular portion with the bend perpendicular to the longitudinal axis of the socket for receiving the contact pin; however, the periphery around the front of the contact socket was often not continuous because of such spring member. The socket, therefore, could be easily deformed and thus lose its ability make good electrical and mechanical contact with the pin. Also, this type of socket is not well protected from tampering or damage from handling when installing wires, installing in a connector or withdrawing the contact from a connector. Furthermore, it might need seals to exclude moisture.

Other socket contacts having an integral spring member have been provided by merely stamping out a finger in the portion of the cylindrical member; however, this method does not alleviate the problem of damage and ease of tampering, especially when repairs are attempted on the damaged contact.

It is, therefore, desirable to provide an electrical contact socket which overcomes these and other disadvantages of the prior art.

OBJECTS OF THE INVENTION

Accordingly, it is one object of the invention to provide an electrical contact socket having integral spring and tubular members.

Another object is to provide an improved electrical contact socket made from sheet metal whereby a spring member is integrally formed with a tubular member and bent inside the tubular member.

Another object is to provide an improved electrical socket contact having closed entry for receiving an associated pin contact and a spring member which is protected by being enclosed inside the socket.

Another object is to provide an electrical contact socket having reliable electrical and mechanical connections with an associated pin contact.

Another object is to provide an improved method for making an electrical socket contact having integral tubular and spring members.

Another object is to provide an electrical contact socket having a substantially closed circular exterior shape.

Another object is to provide a sheet metal contact with a closed circular wire well suitable for crimping without resulting in extreme distortion after crimping.

SUMMARY OF THE INVENTION

In accordance with one form of this invention, there is provided a socket contact for use in electrical connectors having a tubular member adapted to receive an associated pin contact. A spring member attached to the tubular member is included and is inside the tubular member for providing mechanical and electrical contact with the pin contact. The spring member is bent near where it is attached to the tubular member substantially in the same direction as the longitudinal axis of the tubular member.

In accordance with another form of this invention, there is provided a method for forming a socket contact including the steps of forming a rectangular shaped member and an L-shaped member from a single piece of sheet metal; bending the L-shaped member inward substantially parallel to one surface of the rectangular shaped member; and forming the rectangular shaped member to a tubular shape with the L-shaped member being inside the tube.

BRIEF DESCRIPTION OF THE DRAWINGS

The subject matter which is regarded as the invention is set forth in the appended claims. The invention itself, however, together with further objects and advantages thereof, can be better understood by reference to the following description taken in conjunction with the accompanying drawings in which:

DESCRIPTION OF THE PREFERRED EMBODIMENT

Figure 1:
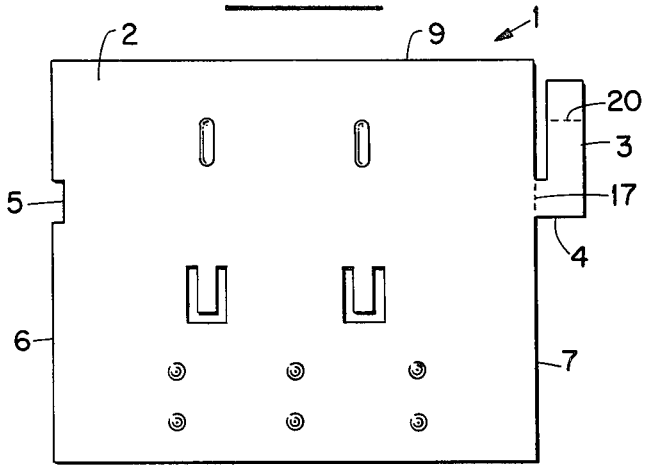
FIG. 1 is a plan view of formed sheet metal after it has been stamped but before it has been bent into the final shape of the socket and which incorporates one aspect of the invention.
Figure 2:
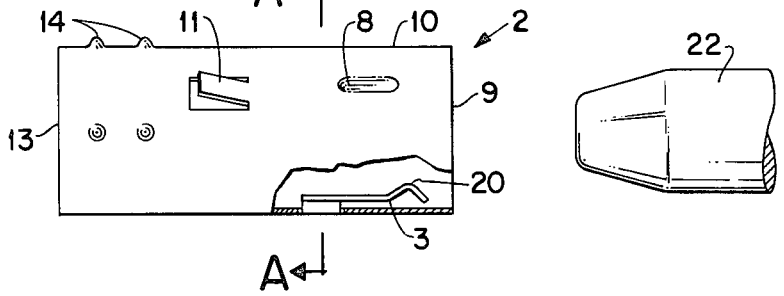
FIG. 2 is the side view of the contact socket, with a portion removed, after the stamped out device in FIG. 1 has been formed into a socket and which incorporates another aspect of the invention.

Referring now more particularly to FIG. 1, there is provided sheet metal stamping 1. This stamping may be formed from an appropriate material, such as copper, having high electrical conductivity. Sheet metal stamping 1 shows the socket contact prior to its being bent into the shape of the tubular contact as shown in FIG. 2. Referring again to FIG. 1, the stamping includes rectangular member 2. Integral with rectangular member 2 is L-shaped member 3, which, after appropriate bending, will become the spring member for providing electrical and mechanical contact to a corresponding contact pin. L-shaped member 3 is integrally attached to rectangular member 2 at the lower portion 4 of the L. On the opposite side to the L-shaped member 3 is slot 5 providing some space for the lower portion 4 of the L-shaped member when the sides 6 and 7 of the rectangular member are welded or otherwise joined together to form a tubular member. Rectangular member 2 includes indents 8 for further providing electrical and mechanical contact with the associated pin contact and for centralizing the pin in the socket.

The associated pin contact will be received in front end of 9 of rectangular member 2. This will be more apparent in reference to FIG. 2. FIG. 2 shows electrical contact 2 having tubular member 10 which, in this embodiment, is in the shape of a cylinder, and a spring member 3. The associated pin contact 22 is received in the front end of socket contact at 9. The spring member 3 is shown to be bent 180° inward from its original position shown in FIG. 1. This aspect is more clearly shown in FIGS. 3, 3A, and 4.

Referring again to FIG. 2, tubular member 10 also includes contact retention tabs 11 and 12, which keep the contact from sliding towards the rear of the connector. Tubular member 10 also includes protrusions 14 which help restrain the contact from sliding in the direction towards the front of the connector. As can be seen from FIG. 2, a portion of the tubular member is shown to be cut away so that the spring member 3 may be seen in its position inside the tubular member. The spring member is completely enclosed by the inner curved surface of the tubular member and is, therefore, substantially tamperproof. Furthermore, it is protected by the tubular member from moisture which could penetrate the contact area and cause corrosion of the spring member.

Figure 3:
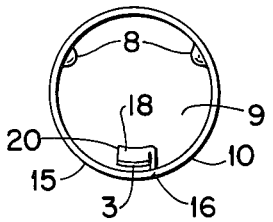
FIG. 3 is a front-end view of the contact socket of FIG. 2.

The spring member 3 is situated in a closed entry contact. The periphery around the front 9 of the contact is continuous which makes it difficult to bend the front of the contact out of shape and thus reduce some of the mechanical and electrical contact effectiveness. This may be more clearly shown in reference to FIG. 3. FIG. 3 shows a front end view of the contact shown in FIG. 2. The periphery 15 around the front end 9 is continuous for providing closed entry of the associated pin contact. The periphery is preferably welded at 16 which corresponds to the sides 6 and 7 of the rectangular member of sheet metal stamping shown in FIG. 1.

Figure 3A:
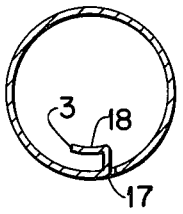
FIG. 3A is a sectional end view of the socket taken through the 180° bend of the spring member.

Indents 8 help provide electrical and mechanical contact with the associated pin contact and centralize the pin in the socket. Spring member 3 provides most of the electrical contact and mechanical pressure to hold the associated pin contact in the socket. As can be seen, the spring member has been bent approximately 180° toward the inner surface of the tubular member from its original stamped position shown in FIG. 1. The direction of the 180° bend is on a line parallel to the longitudinal axis of the contact. As can be seen in FIG. 3A, the 180° bend occurs at the lower portion 17 of the spring member 3 which is analogous to attachment portion 4 of the L-shaped member shown in FIG. 1. Near the free end of the spring member is bend 20 which effectively raises the spring member farther above the inner surface of the tubular member 10, than the portion of the spring member near the 180° bend and the free end. This bend 20 helps provide the spring force to retain the pin in the socket as well as provide good electrical contact. As can be seen in FIG. 3, the spring member may be curved as indicated by 18 to substantially conform to the shape of the associated male pin as well as being curved substantially with the same radius as the tubular member 10.

Figure 4:
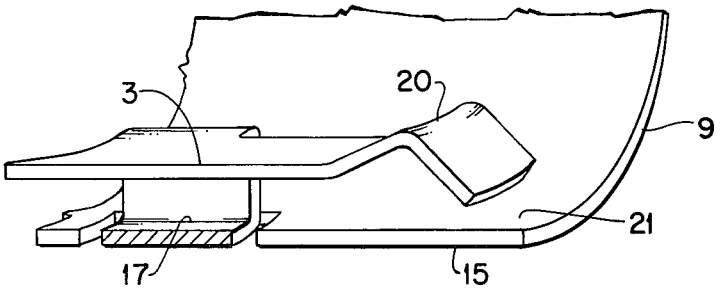
FIG. 4 shows the broken-away portion of the view shown in FIG. 2.

Referring now to FIG. 4, there is provided a more detailed version of the spring member 3 in its relation to a portion of the tubular member 10. As can be seen in FIG. 4, spring member 3 is bent approximately 180° from its original position as shown in FIG. 1 indicated at bend 17. This bend is approximately along a line parallel to the longitudinal axis of the tubular member. As stated previously, spring member 3 is further bent along line 20 to help provide spring force to retain the pin. This bend 20 also helps provide a smooth access for the contact pin. This second bend is down and toward the inner surface 21 of tubular member 10. Bend 20 towards the free end of the spring member 3 allows the pin as it is inserted to easily compress the spring. Without this bend, the associated pin might force the spring member upward and thus jam the socket. It is, therefore, apparent that bend 20 includes the dual function of providing spring force and smooth entry for a pin contact.

From the above description, it can be seen that the improved socket contacts provide a reliable, mechanical and electrical connection for an associated male pin utilizing stamped sheet metal contact. The socket provides a closed entry system, a monolithic tubular and spring member and protection for the spring as well as reduction of the entry of moisture and other foreign elements into the socket.

The improved socket contact is formed in the following manner:

A piece of sheet metal, such as copper, is stamped into integral rectangular and L-shaped members 2 and 3, respectively, as shown in FIG. 1. The L-shaped spring member outer surface 18 may be curved with a radius of curvature approximately equal to that of the socket. The L-shaped member is bent approximately 180° at attachment portion 4 toward one surface of the rectangular member. The free end of the L-shaped member (now spring member 3) is also bent along line 20 further toward the surface of the rectangular member. The rectangular member is then formed into a cylinder and welded along its sides 6 and 7.

From the foregoing description of the illustrative embodiment of the invention, it will be apparent that many modifications may be made therein. It will be understood that this embodiment of the invention is intended as an exemplification of the invention only and that this invention is not limited thereto. It is also to be understood, therefore, that it is intended in the appended claims to cover all modifications that fall within the true spirit and scope of the invention.

I claim:

1. A socket contact for use in an electrical connector comprising: a tubular member adapted to receive a corresponding pin contact; a spring member attached to said tubular member, said spring member for providing mechanical and electrical contact with the pin contact; said spring member including a first bent portion near where said spring member is attached to said tubular member, said first bent portion being in substantially the same direction as the longitudinal axis of said tubular member; means for providing spring force for said spring member; said spring member being entirely inside said tubular member whereby all of said spring member is protected by said tubular member.

2. A socket as set forth in claim 1 wherein the periphery of the end of said tubular member which is adapted to receive the pin contact is substantially continuous.

3. A socket as set forth in claim 1 wherein the portion of said tubular member associated with said spring member is substantially closed.

4. A socket as set forth in claim 1 further including at least one indent in said tubular member in the region near said spring member, said indent adapted to make electrical and mechanical contact with a pin contact.

5. A socket as set forth in claim 1 wherein said tubular member is cylindrical in shape; at least a portion of said spring member being curved at approximately the same radius of curvature as said tubular member.

6. A socket as set forth in claim 1 wherein said means for providing spring force includes a second bent portion on said spring member, said second bent portion being removed from said first bent portion for providing spring force and smooth entry when a corresponding pin is inserted in said socket.

7. A socket as set forth in claim 6 wherein said second bent portion is elevated from the remaining portion of said spring member.

8. A socket as set forth in claim 1 wherein said tubular member and said spring member are integral.

9. A socket as set forth in claim 8 wherein said spring member is substantially in the shape of an L projecting inside said tubular member.

10. A socket as set forth in claim 8 wherein said first bent portion is turned approximately 180° with respect to its original pre-bent position.

11. A socket as set forth in claim 10 further including a slot in said tubular member, said slot being adjacent to said first bent portion.

12. A socket contact for use in electrical connectors comprising: a tubular member adapted to receive an associated pin contact; a spring member integral with said tubular member, said tubular member and said spring member having been stamped from a piece of sheet metal, said spring member being located entirely inside of said tubular member for protecting all of said spring member; a portion of said spring member being bent at its place of attachment with said tubular member approximately 180° from its original stamped position; a portion near the end of said spring member opposite said attachment place being bent in a direction toward the inner surface of said tubular member for receiving an associated pin contact.

13. A socket contact as set forth in claim 12 wherein said portion near the end of said spring member located between said 180° bend and said opposite end is elevated above the inner surface of said tubular member to a degree substantially greater than the remainder of said spring member.

14. A method of forming a socket contact having a tubular member and a spring member integral therewith comprising the steps of: forming an integral, rectangular shaped member and an L-shaped member from a piece of sheet metal; bending said L-shaped member inwardly substantially parallel to one surface of said rectangular shaped member; forming said rectangular shaped member to a tubular shaped member with all of said L-shaped member being inside said tubular shaped member, whereby said tubular shaped member protects all of said L-shaped member.

15. A method as set forth in claim 14 further including the step of bending one end of said L-shaped member toward the inner surface of said tubular shaped member.

16. A method as set forth in claim 14 further including the step of curving a portion of said L-shaped member in approximately the same radius of curvature as said tubular shape member.

* * * * *